US007749001B2

(12) United States Patent
Ma

(10) Patent No.: US 7,749,001 B2
(45) Date of Patent: Jul. 6, 2010

(54) COMPUTER PERIPHERAL DEVICE WITH A MOVABLE PROTECTIVE SHELTER BODY

(76) Inventor: Tien-Chi Ma, No. 75, Sec. 2, Minquan E. Rd., Zhongshan District, Taipei City (TW)

( * ) Notice: Subject to any disclaimer, the term of this patent is extended or adjusted under 35 U.S.C. 154(b) by 0 days.

(21) Appl. No.: 12/379,960

(22) Filed: Mar. 5, 2009

(65) Prior Publication Data

US 2009/0227144 A1 Sep. 10, 2009

(30) Foreign Application Priority Data

Mar. 7, 2008 (TW) ..... 97203827 U

(51) Int. Cl.
*H01R 13/44* (2006.01)
*H01R 13/60* (2006.01)

(52) U.S. Cl. ..... 439/131; 439/140

(58) Field of Classification Search ..... 439/131, 439/136, 140, 141, 142, 138, 620.15
See application file for complete search history.

(56) References Cited

U.S. PATENT DOCUMENTS 2,486,607 A * 11/1949 Laystrom et al. ..... 242/599.3
2,713,445 A * 7/1955 Speck ..... 24/265 WS
4,935,910 A * 6/1990 Akasaka et al. ..... 368/282
6,758,689 B1 * 7/2004 Bair et al. ..... 439/136
7,043,895 B2 * 5/2006 Mace ..... 59/80
7,287,705 B2 * 10/2007 Tang ..... 235/492
7,333,399 B2 * 2/2008 Ellner et al. ..... 368/88
D566,114 S * 4/2008 Chu ..... D14/356
7,364,445 B1 * 4/2008 Ni et al. ..... 439/140
7,422,454 B1 * 9/2008 Tang et al. ..... 439/131
7,524,198 B2 * 4/2009 Nguyen et al. ..... 439/131
7,535,719 B2 * 5/2009 Hiew et al. ..... 361/737
7,558,069 B2 * 7/2009 Chung ..... 361/737
7,558,070 B2 * 7/2009 Kang ..... 361/752
2007/0292009 A1 * 12/2007 Nguyen et al. ..... 382/124

* cited by examiner

*Primary Examiner*—Hae Moon Hyeon
(74) *Attorney, Agent, or Firm*—Bacon & Thomas, PLLC

(57) ABSTRACT

A computer peripheral device includes a casing, a main body and a shelter body. The casing includes two parallel sidewalls to define a first containing space for fixing the main body. A connecting terminal is on a lateral surface and proximate to the main body and with its back facing the first containing space. The casing includes at least one shaft having an elastic insert pin at each end of the shaft, and an end of each elastic insert pin is penetrated through two sidewalls. A second containing space is formed between the two sidewalls of the shelter body and a slide slot is formed on each sidewall. When the shelter body is covered onto the casing, the casing can be accommodated in the second containing space, and an end of each elastic insert pin is embedded into each slide slot, so that the connecting terminal can exposed or covered.

6 Claims, 9 Drawing Sheets

COMPUTER PERIPHERAL DEVICE WITH A MOVABLE PROTECTIVE SHELTER BODY

FIELD OF THE INVENTION

The present invention relates to a computer peripheral device, and more particularly to a portable computer peripheral device having a shelter body for selectively covering or exposing a connecting terminal and protecting the connecting terminal.

BACKGROUND OF THE INVENTION

As the high-technology industry blooms and the telecommunication network advances rapidly, various different computer peripheral devices (such as flash disks, Bluetooth transceivers and portable hardware keys) for microcomputer devices (such as personal computers, digital cameras, personal digital assistants) are introduced to the market, and the price becomes increasingly lower, and thus computer peripheral devices are used extensively. Among these computer peripheral devices, the one with a universal serial bus (USB) transmission interface is very popular in the market and used extensively by users. Since USB computer peripheral devices come with a hot plug function and the capacity of a flash memory is increased continuously, such computer peripheral devices can be provided for designers to code a large number of programs or storing a large quantity of digital data. Therefore, the USB computer peripheral devices become one of the necessary peripherals.

For instance, a flash disk is used for illustrating a computer peripheral device. With reference to FIG. 1, a conventional flash disk 1 comprises a casing 10, a main body 11, a foolproof frame 12 and an external cover 13. The casing 10 is formed by engaging an upper casing 101 and a lower casing 102, and both upper and lower casings 101, 102 have a U-shaped cross-section to define a containing space in the casing 10. The main body 11 is formed by combining a circuit board 111 and a connecting plate 112, and the circuit board 111 is disposed in the containing space and covered within the casing 10 for protecting electronic components on the circuit board 111 from being damaged. The connecting plate 112 is exposed from an end of the casing 10 and has a connecting terminal 1121 disposed on a lateral surface for connecting the connecting terminal 1121 with a circuit on the circuit board 111, such that when the flash disk 1 is plugged into a socket of another microcomputer device, the flash disk 1 is electrically connected to the microcomputer device. The foolproof frame 12 is a rectangular hollow frame, with an end connected to an end of the casing 10 for installing the connecting plate 112 in the foolproof frame 12, so as to prevent users from plugging the flash disk 1 in a wrong direction, and the connecting terminal 1121 of the connecting plate 112 will not be in contact with the foolproof frame 12 to prevent the connecting terminal 1121 from unable to electrically connect to the microcomputer device. A groove 130 is disposed at an end of the external cover 13 and connected to an end of the casing 10 for accommodating the foolproof frame 12 together with the connecting plate 112, so as to prevent the connecting plate 112 from adhering dusts or other foreign matters (such as oil stains, and hairs) or causing a poor contact of a connecting terminal 1121 on the connecting plate 112 with other microcomputer devices when the flash disk 1 is not in use, and thus such arrangement causes an inconvenience of use. When a user wants to use the aforementioned flash disk 1, the user has to remove the external cover 13 from the casing 10 before connecting the connecting plate 112 with a socket of another microcomputer device. When the user uses the flash disk 1, it is necessary to find a place to put the external cover 13, and users may lose the external cover 13 easily without paying attention to where it was put. If the external cover 13 is missing, then the user has to find an external cover 13 of the same model to fit the casing 10, and it definitely causes inconvenience to the use. In addition, the manufacturing process of the aforementioned flash disk 1 is very complicated, and requires installing components one by one. Since the components are made of different materials, the assembling process will be very complicated and the manufacturing cost will be very high.

Therefore, manufactures have developed a rotating foldable computer peripheral device as shown in FIG. 2, the foldable computer peripheral device comprises a casing 20, a circuit board 21 and a bending plate 22, wherein an opening 201 is disposed at an end of the casing 20 to define a containing space 202 therein for fixing the circuit board 21, and a connecting terminal 211 is disposed on a lateral surface of the circuit board 21 and at a position proximate to the opening 201 of the casing 20, and the connecting terminal 211 is not in contact with the casing 20. The bending plate 22 is substantially U-shaped, with both ends parallelly extended outward to a free end, and another end of the opening 201 disposed at a position away from the casing 20 is pivotally coupled to both free ends at a position proximate to the bending plate 22 for turning the casing 20 and accommodating the casing 20 into the bending plate 22, or being turned out from the bending plate 22, so as to overcome the aforementioned issue of having a risk of losing the external cover easily. However, the casing 20 of such foldable computer peripheral device is not fixed into the bending plate 22, the casing 20 may be turned out from the bending plate 22 unintentionally after the user folds and stores the flash disk in a bag, and the casing 20 will be compressed and deformed. As a result, the flash disk no longer cannot be stored into the bending plate 22 anymore. Although the casing 20 can be contained in the bending plate 22, yet both sides of the bending plate 22 are open. Therefore, dusts or foreign matters may enter into the casing 20 easily, and the failure rate of the connecting terminal 211 on the circuit board 21 inside the casing 20 is increased significantly.

In the aforementioned two types of computer peripheral devices, their size is limited by the size of the circuit board and cannot be reduced effectively. Such devices not only fail to meet the compact design requirement, but also consume more materials for the manufacture and incur a higher cost. Some manufacturers use a Chip On Board (COB) technology to integrate all circuits into a circuit board of the computer peripheral device, and build a connecting terminal to be plugged into a socket of another microcomputer device. However, such computer peripheral device does not have an additional component for protecting the connecting terminal, and the connecting terminal may be damaged easily.

Therefore, it is an important subject for computer peripherals manufacturers to design a computer peripheral device capable of preventing the connecting terminal of the computer peripheral device from being damaged and preventing the external cover of the computer peripheral device from being lost easily, so as to avoid inconvenience to users, lower the production cost effectively, and overcome the foregoing shortcomings of the traditional computer peripheral devices.

SUMMARY OF THE INVENTION

In view of the foregoing shortcomings of the prior art, the inventor of the present invention based on years of experience in the related industry to conduct extensive researches and experiments, and finally developed a computer peripheral device in accordance with the present invention.

Therefore, it is a primary objective of the present invention to provide a computer peripheral device, comprising: a casing, being a plate having a substantially U-shaped cross-section with two corresponding first sidewalls, and a first containing space formed between the first sidewalls for fixing a main body, wherein the main body is a flat plate having a connecting terminal disposed on a lateral surface at an end of the main body and the back of the main body is aligned in a direction towards the first containing space, such that when an end of the computer peripheral device is plugged into a socket of another computer product, the connecting terminal is electrically connected to the socket. The casing has at least one shaft disposed at a position away from the connecting terminal, and an elastic insert pin is disposed separately on both ends of the shaft, and an end of each elastic insert pin is penetrated through the two first sidewalls and at a position away from the main body. The casing is connected to a shelter body, and two second sidewalls are disposed on a surface of the shelter body, and the two second sidewalls are parallel to each other and form a second containing space. A slide slot is disposed separately on internal sides of two second sidewalls of the shelter body, such that when the shelter body is sheathed onto the exterior of the casing, the casing can be accommodated in the second containing space, and an end of each elastic insert pin is embedded into each slide slot. If a user pushes the shelter body to move the shelter body in a direction towards the connecting terminal, then the shelter body will cover the connecting terminal to prevent the connecting terminal from being contaminated by dusts or foreign matters or avoid the connecting terminal from being damaged by collisions. If the user pushes the shelter body to move the shelter body in a direction away from the connecting terminal, the connecting terminal will be exposed, such that an end of the casing of the computer peripheral device can be plugged into sockets of another microcomputer device (such as a personal computer, a digital camera, and a personal digital assistant, etc).

Another objective of the present invention is to provide a computer peripheral device comprising: a casing, a main body and a shelter body, wherein the casing has a U-shaped cross-section, and a first sidewall is disposed separately on both corresponding sides of the casing, and a first containing space is formed between the sidewalls, and the main body is a flat plate fixed in the first containing space and includes a connecting terminal disposed on a lateral surface at an end of the main body and the back of the connecting terminal is aligned towards the first containing space, such that the connecting terminal can be electrically connected with a socket of another microcomputer device. The casing has a shaft installed at the position away from the connecting terminal, and an elastic insert pin is disposed separately on both ends of the shaft, and an end of each elastic insert pin penetrates through the main body and at a position away from the two first sidewalls. Two second sidewalls are disposed on a surface of the shelter body, and the two second sidewalls are parallel to each other, and a second containing space is formed between the two second sidewalls, so that when the shelter body is sheathed onto the external side of the casing, the casing can be accommodated in the second containing space, and an embedding hole is disposed on an internal side of the second sidewall of the shelter body for embedding an end of each elastic insert pin. If a user uses a finger to apply a force to the shelter body, the shelter body can be turned pivotally with respect to an axis of the shaft to expose or cover the connecting terminal according to the direction of the force applied by the user onto the shelter body.

A further objective of the present invention is to manufacture a casing and a shelter body of the computer peripheral device integrally by a stamping technology, and a Chip On Board (COB) technology is adopted for packaging circuits of the computer peripheral device, and thus the overall volume of the computer peripheral device can be reduced effectively to meet the requirements of a compact design and the portability of the computer periphery device. In addition, the production materials and costs can be lowered effectively after the overall volume of the computer peripheral device is reduced.

Another objective of the present invention is to provide a computer peripheral device that allows a user to apply a force on a shelter body of the computer peripheral device by a hand to expose or cover a connecting terminal of the computer peripheral device, so as to greatly improve the convenience of the user's operation, wherein the casing and the shelter body of the computer peripheral device are connected by combining a shaft and an elastic insert pin, so that users can remove the shelter body easily or change the appearance form of the shelter body to satisfy the user requirement for a change of different stylish design of the peripheral device.

The objects, technical characteristics and effects of the present invention will become apparent from the following detailed description taken with the accompanying drawings.

DETAILED DESCRIPTION OF THE PREFERRED EMBODIMENTS

To make it easier for our examiner to understand the technical characteristics of the present invention, we use preferred embodiments together with the accompanying drawings for the detailed description of the invention as follows:

The present invention discloses a computer peripheral device (such as a flash disk, a Bluetooth transceiver and a portable hardware key, etc) connected to a socket of a microcomputer device (such as a personal computer, a digital camera, and a personal digital camera, etc), and the computer peripheral device has a transmission terminal of a universal serial bus (USB), IEEE 1394 (Firewire) or any other interface specification. To cope with the models of various different transmission interfaces, persons ordinarily skilled in the art can make appropriate modifications to the shape of the casing and the connecting terminal of the present invention, and these modifications are intended to be covered in the scope of the present invention.

Figure 1:
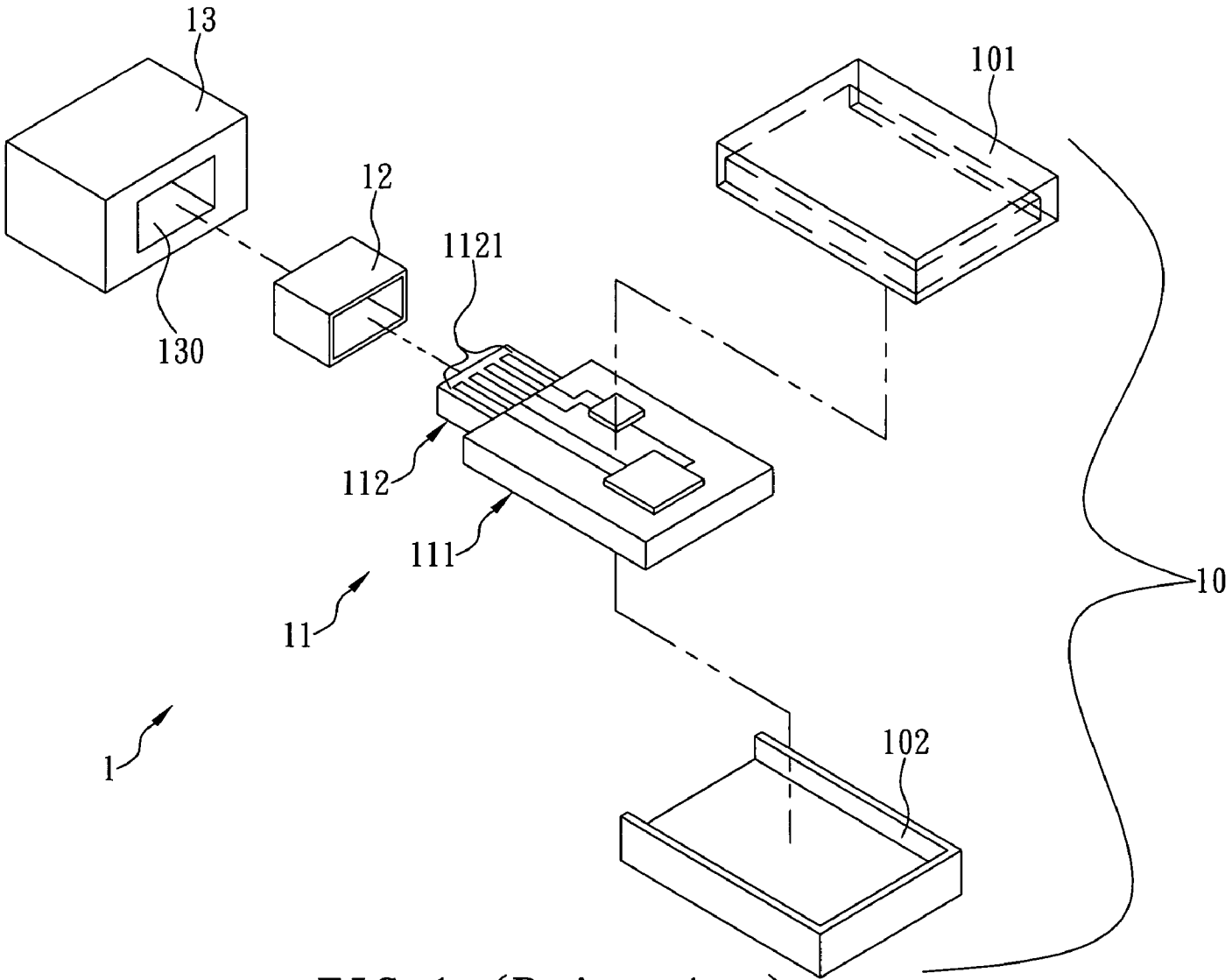
FIG. 1 (Prior Art)
FIG. 1 is a schematic view of a conventional computer peripheral device.
Figure 2:
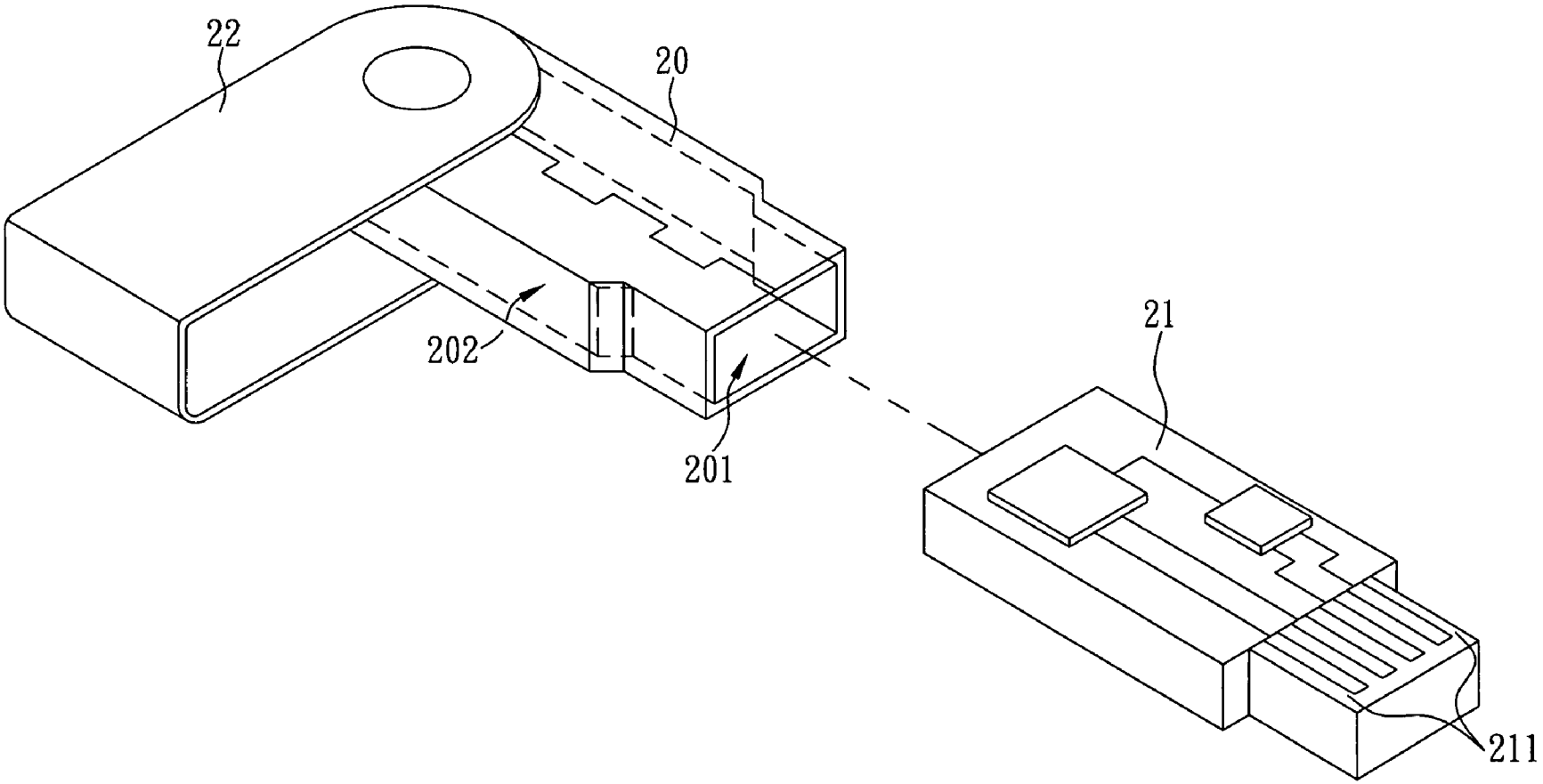
FIG. 2 (Prior Art)
FIG. 2 is a schematic view of another conventional computer peripheral device.
Figure 3:
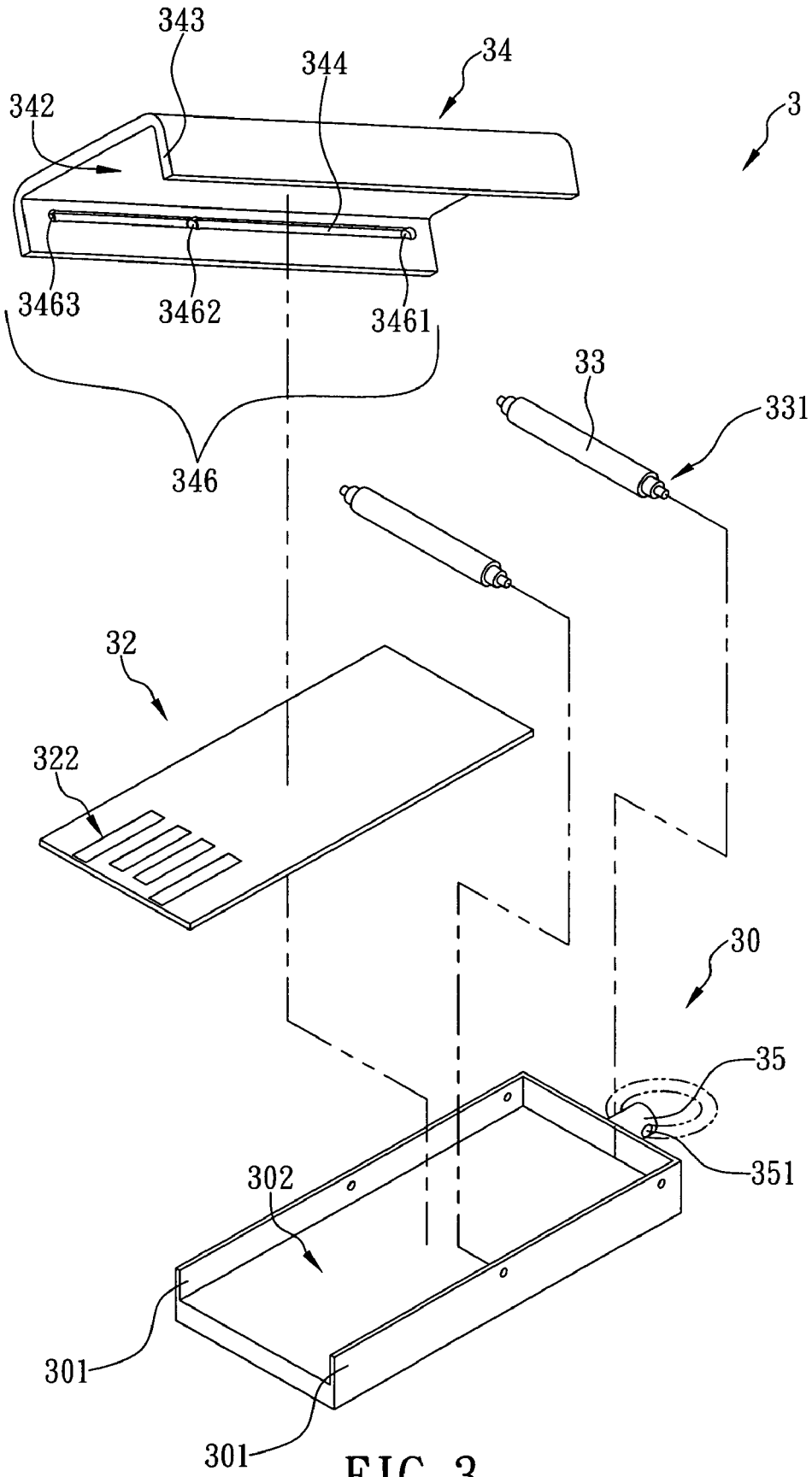
FIG. 3 is an exploded view of a preferred embodiment of the present invention.
Figure 4:
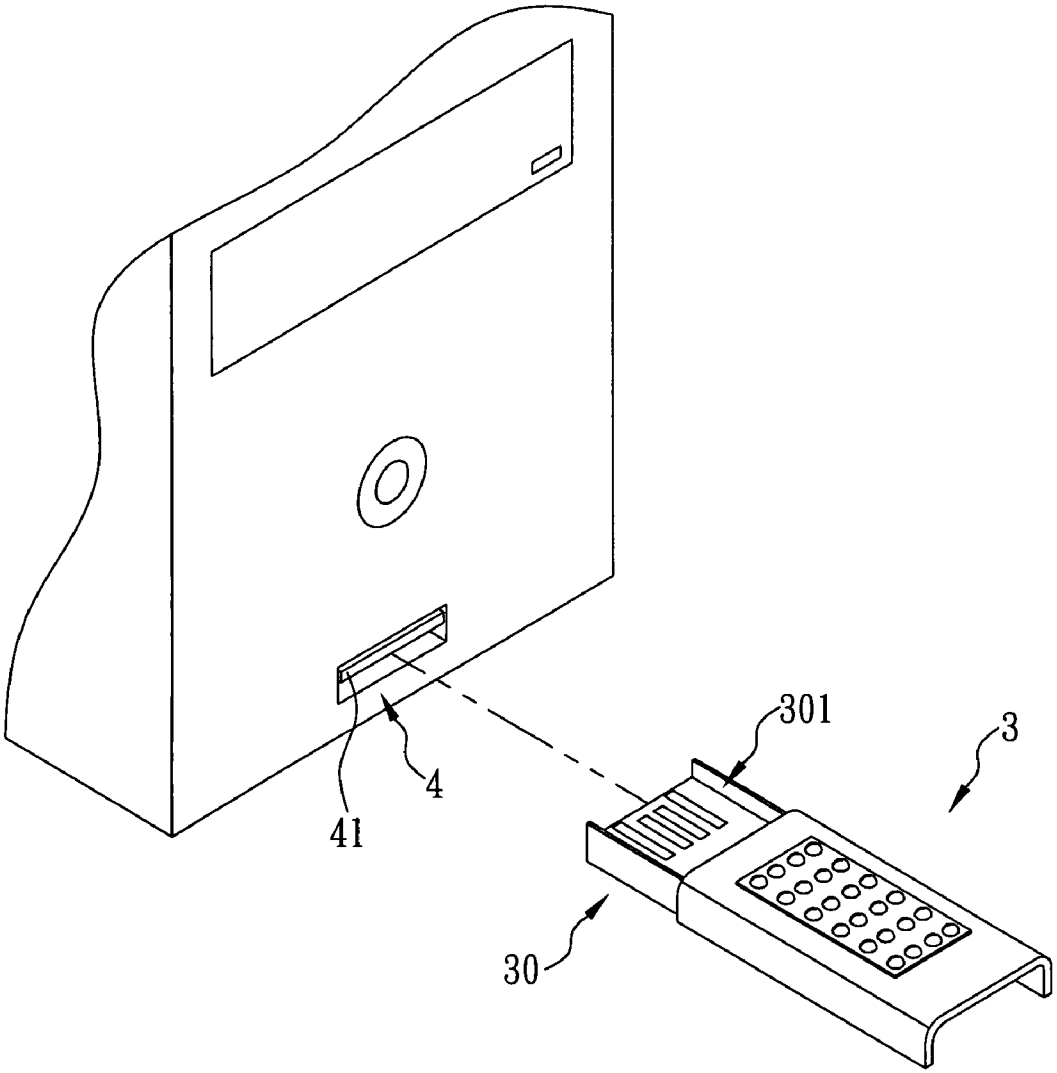
FIG. 4 is a schematic view of using a computer peripheral device in accordance with the present invention.

With reference to FIG. 3, the computer peripheral device 3 comprises a casing 30, a flat-plate shaped main body 32 and a shelter body 34, wherein the casing 30 is a plate with a U-shaped cross-section and includes two corresponding first sidewalls 301 parallel to each other, and the two first sidewalls 301 come with a height of 3 mm to 4 mm for preventing the computer peripheral device 3 from being inserted into the socket of the microcomputer device from a wrong direction that will make the computer peripheral device inoperable, and a first containing space 302 is formed between the first sidewalls 301, and the main body 32 is fixed in the first containing space 302, and electronic components required for the operation of the computer peripheral device 3 are packaged directly in the main body 32 by a Chip On Board (COB) technology, and a connecting terminal 322 is disposed on a lateral surface and at a position proximate to an end of the main body 32, and the back of the connecting terminal 322 is aligned towards the first containing space 302 and connected to the electronic components in the main body 32, such that when an end of the computer peripheral device 3 is plugged into a socket of another microcomputer device, the connecting terminal 322 will be electrically connected to the socket, and the computer peripheral device 3 can have interactions with the microcomputer device. With reference to FIG. 4, when a user inserts the computer peripheral device 3 into a socket 4, the first sidewalls 301 are embedded into the socket 4, and the connecting terminal 322 is electrically connected to an insert terminals 41 in the socket 4. If the user inserts the computer peripheral device 3 into the socket 4 in a wrong direction, the computer peripheral device 3 will be blocked by the two first sidewalls 301, and the computer peripheral device 3 cannot be inserted into the socket 4 successfully. The foolproof design of the present invention can prevent users from installing the computer peripheral device in a wrong direction.

In FIG. 3, the casing 30 includes at least one shaft 33 disposed at a position away from the connecting terminal 322, and two shafts 33 are used as an example for illustrating the computer peripheral device 3 of this embodiment. Both ends of the two shafts 33 have an elastic insert pin 331 separately, and the elastic insert pin 331 is capable of applying an action force in a direction opposite to the shaft 33, such that when the elastic insert pin 331 is compressed, the elastic insert pin 331 will be moved towards the shaft 33. In addition, an end of each elastic insert pin 331 is penetrated through the two first sidewalls 301 and at a position away from the main body 32. Two second sidewalls 343 are disposed on a surface of the shelter body 34, and internal surfaces of the two second sidewalls 343 are parallel to each other. A back of the shelter body 34 faces towards a surface of the main body 32. A second containing space 342 is formed between the two second sidewalls 343, and a slide slot 344 is disposed separately on the internal surfaces of the two second sidewalls 343 of the shelter body 34. When the shelter body 34 is sheathed onto the exterior of the casing 30, the casing 30 can be accommodated in the second containing space 342, and an end of each elastic insert pin 331 can be embedded into each slide slot 344, such that when a user uses a finger to apply a force to the shelter body 34, each elastic insert pin 331 can be moved in the slide slot 344 to drive the shelter body 34 to move on the casing 30, and the connecting terminal 322 can be exposed or accommodated between the casing 30 and the shelter body 34.

Figure 5:
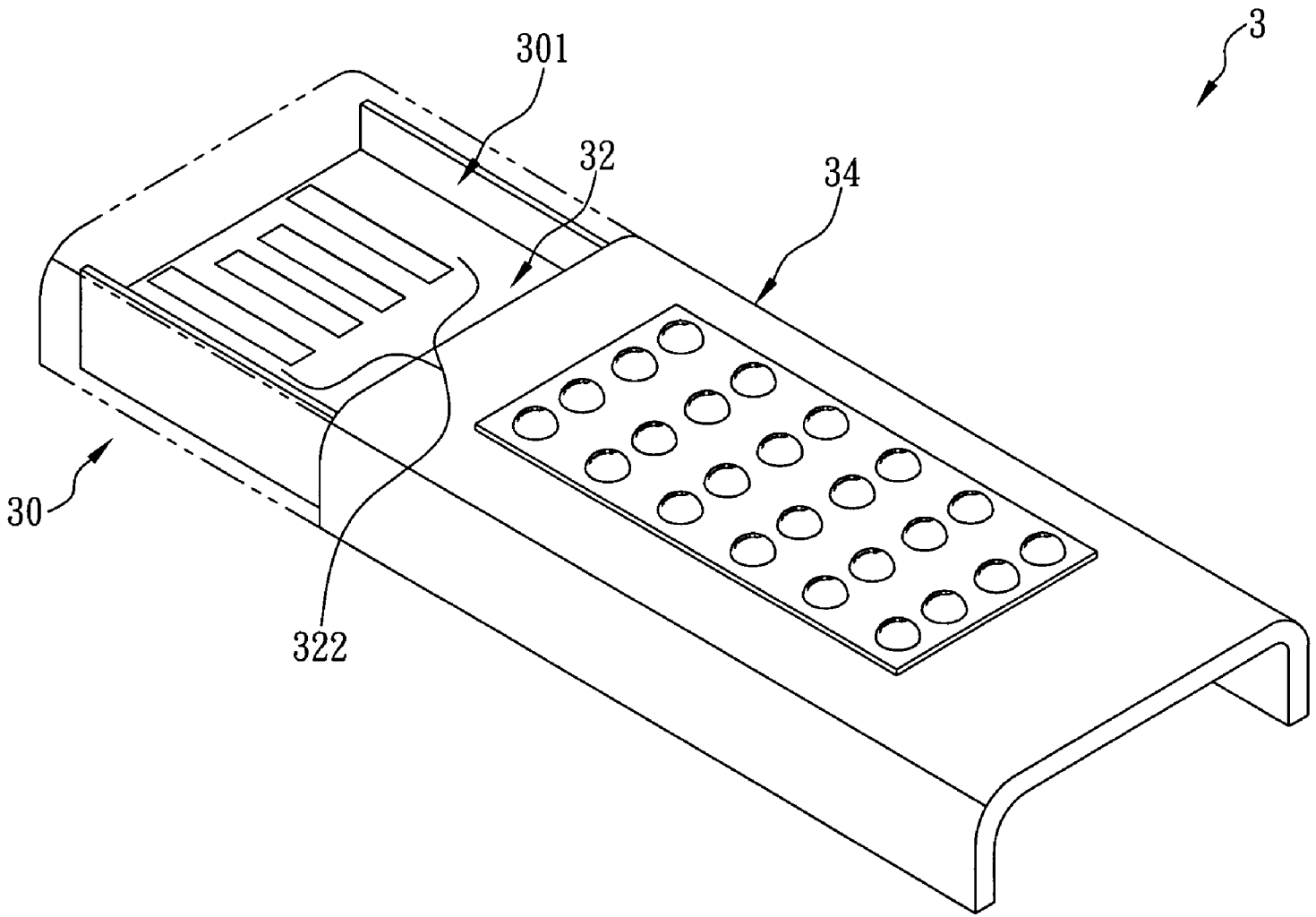
FIG. 5 is a schematic view of open and shut states of the present invention.

In FIG. 5, when the shelter body 34 and the casing 30 are engaged and connected with each other, a user can apply a force onto the shelter body 34 to push the shelter body 34 to in a direction away from the connecting terminal 322 to expose the connecting terminal 322, so that the user can plug the computer peripheral device 3 into a socket 4 of another microcomputer device (as shown in FIG. 4). After the user has finished using the computer peripheral device 3, the user can push the shelter body 34 to move the shelter body 34 in a direction towards the connecting terminal 322, and the shelter body 34 will cover the connecting terminal 322 (as shown in the dotted line of FIG. 5) to prevent dusts from contaminating the connecting terminal 322 or damages to the connecting terminal 322 due to collisions.

In FIG. 3, the slide slot 344 further includes three positioning slots 346 in this preferred embodiment, but the present invention is not limited to three positioning slots only, but any number (equal to or greater than one) of the positioning slots of the slide slot can be used instead to improve the manufacturing efficiency of the shelter body. The three positioning slots 346 are a first positioning slot 3461, a second positioning slot 3462 and a third positioning slot 3463, wherein the first positioning slot 3461 is situated at a position farthest from the connecting terminal 322, and the sunken depth of the positioning slots 346 is greater than that of the slide slot 344, such that when the shelter body 34 covers the connecting terminal 322, the elastic insert pins 331 on the two shafts 33 are disposed in the first positioning slot 3461 and the second positioning slot 3462 respectively. If a user pushes the shelter body 34 to expose the connecting terminal 322, each elastic insert pin 331 will be moved into the second positioning slot 3462 and the third positioning slot 3463. After each elastic insert pin 331 is moved to each positioning slot 346, the user has to apply a larger force to push the shelter body 34, so that the user has a hand feel to determine whether or not the connecting terminal 322 is exposed or covered. Such arrangement improves the convenience of the use of the computer peripheral device.

Figure 6:
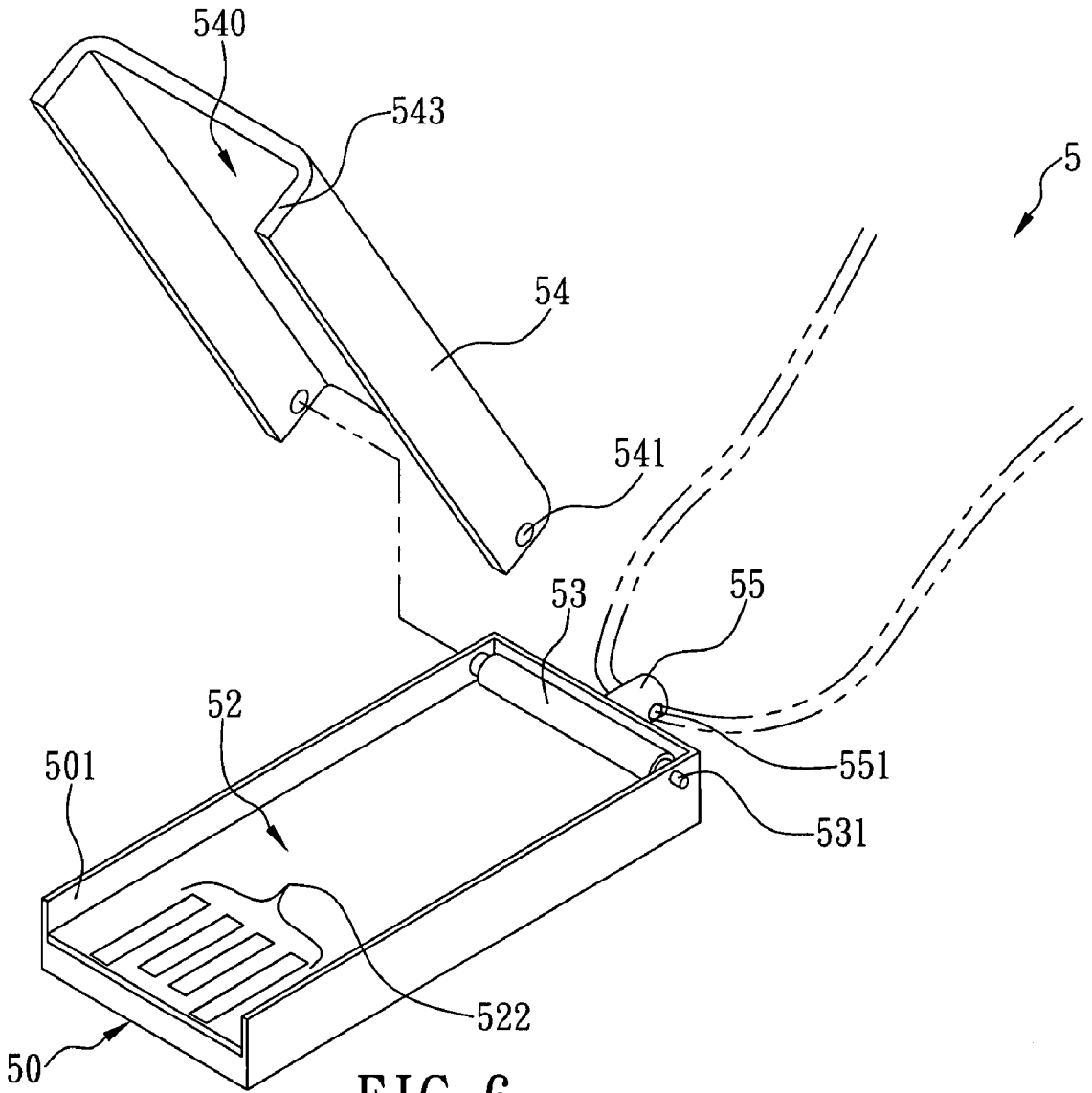
FIG. 6 is a schematic view of another preferred embodiment of the present invention.

With reference to FIG. 6 for another preferred embodiment of the present invention, the computer peripheral device 5 comprises a casing 50, being a U-shaped plate and having two parallel corresponding first sidewalls 501, a first containing space formed between the two first sidewalls 501, a main body 52 fixed in the first containing space, and a connecting terminal 522 disposed on a lateral surface proximate to an end of the main body 52, such that when the computer peripheral device 5 is plugged into a socket of another microcomputer device, the computer peripheral device 5 is electrically connected to the socket. In addition, the two first sidewalls 501 can be embedded into socket only if the connecting terminal 522 is electrically connected with the socket. The foolproof arrangement can prevent users from plugging the computer peripheral device into the socket in a wrong direction. The casing 50 includes a shaft 53 disposed at a position away from an end of the connecting terminal 522, and an elastic insert pin 531 is disposed separately on both ends of the shaft 53, and the two elastic insert pins 531 away from an end of the shaft 53 is penetrated into the two first sidewalls 501 and exposed from the two first sidewalls 501 and disposed at a position away from side of the main body 52. In addition, a shelter body 54 is connected to the casing 50, and two second sidewalls 543 are disposed on a surface of the shelter body 54, and corresponding internal sides of the two second sidewalls 543 are parallel to each other. A second containing space 540 is formed between the two second sidewalls 543, and the casing 50 can be accommodated in the second containing space. An embedding hole 541 is disposed separately disposed on internal sides of two second sidewalls 543 of the shelter body 54, and an end of the two elastic insert pins 531 is embedded into each of the two embedding holes 541 for rotating the shelter body 54 by using the shaft 53 as the axis. If a user applies a force onto the shelter body 54 to move and turn the shelter body 54 in a direction away from the main body 52, the connecting terminal 522 will be exposed for the user to plug the connecting terminal 522 into a socket of another microcomputer product to achieve an electric connection. If the user applies a force onto the shelter body 54 to move and turn the shelter body 54 in a direction towards the main body 52, the connecting terminal 522 will be covered by the shelter body 54 to prevent the connecting terminal 522 from being contaminated by dusts or prevent the connecting terminal 522 from being damaged due to collisions.

Figure 7A:
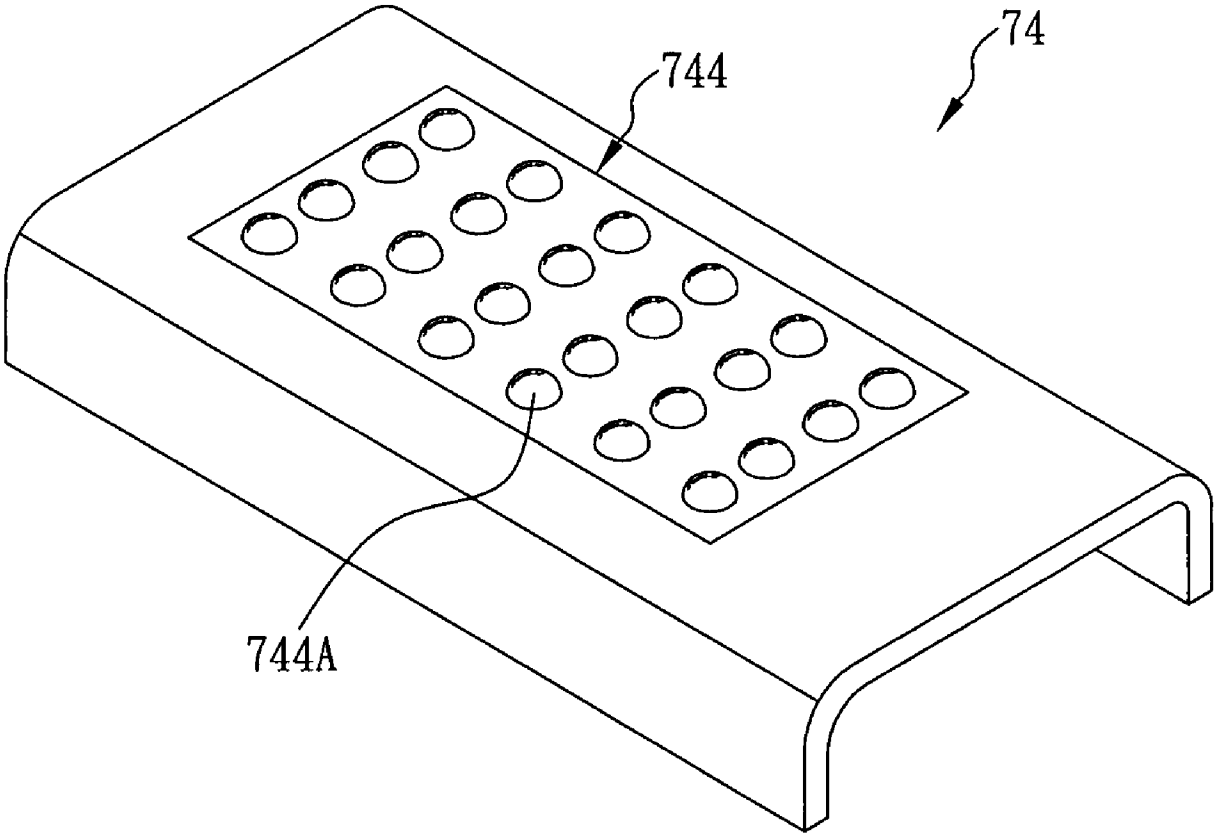
FIG. 7A is a schematic view of a shelter body of the present invention.
Figure 7B:
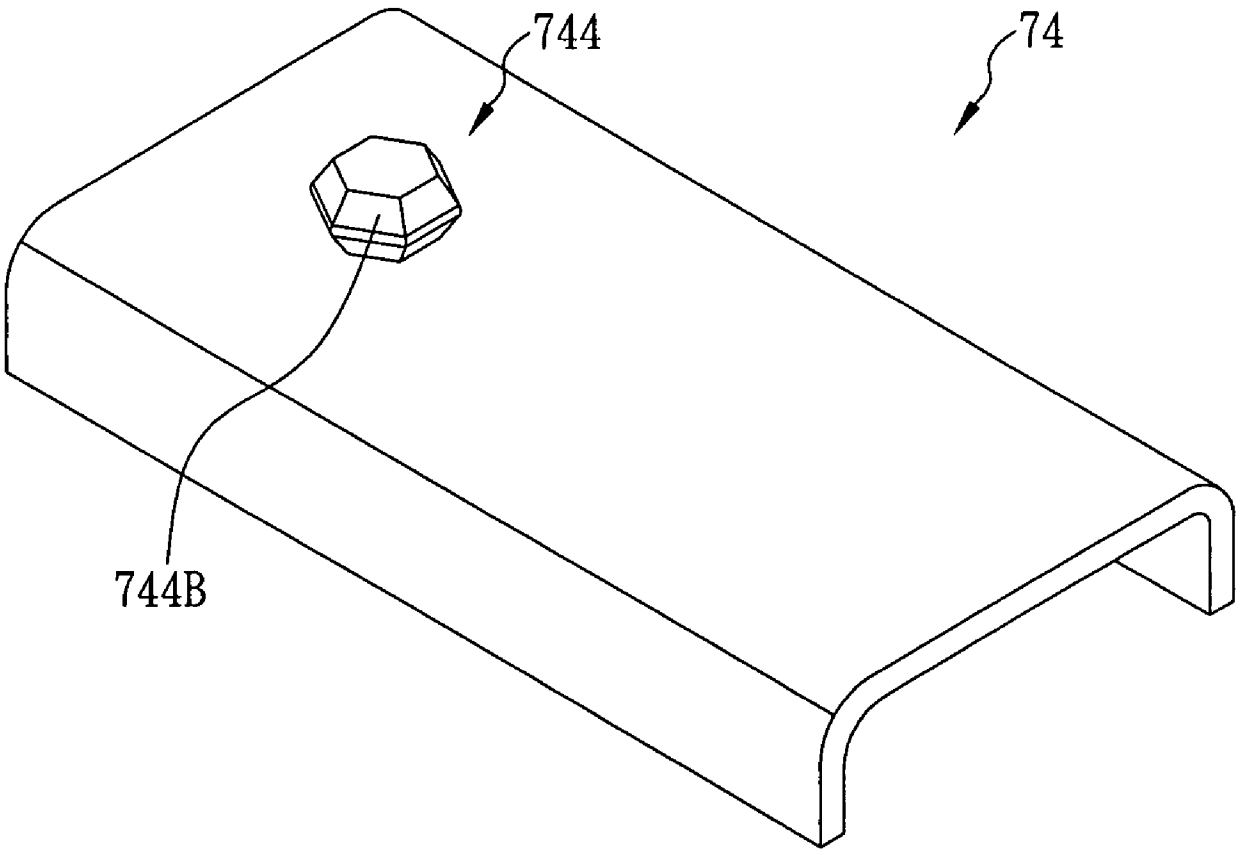
FIG. 7B is another schematic view of a shelter body of the present invention.
Figure 7C:
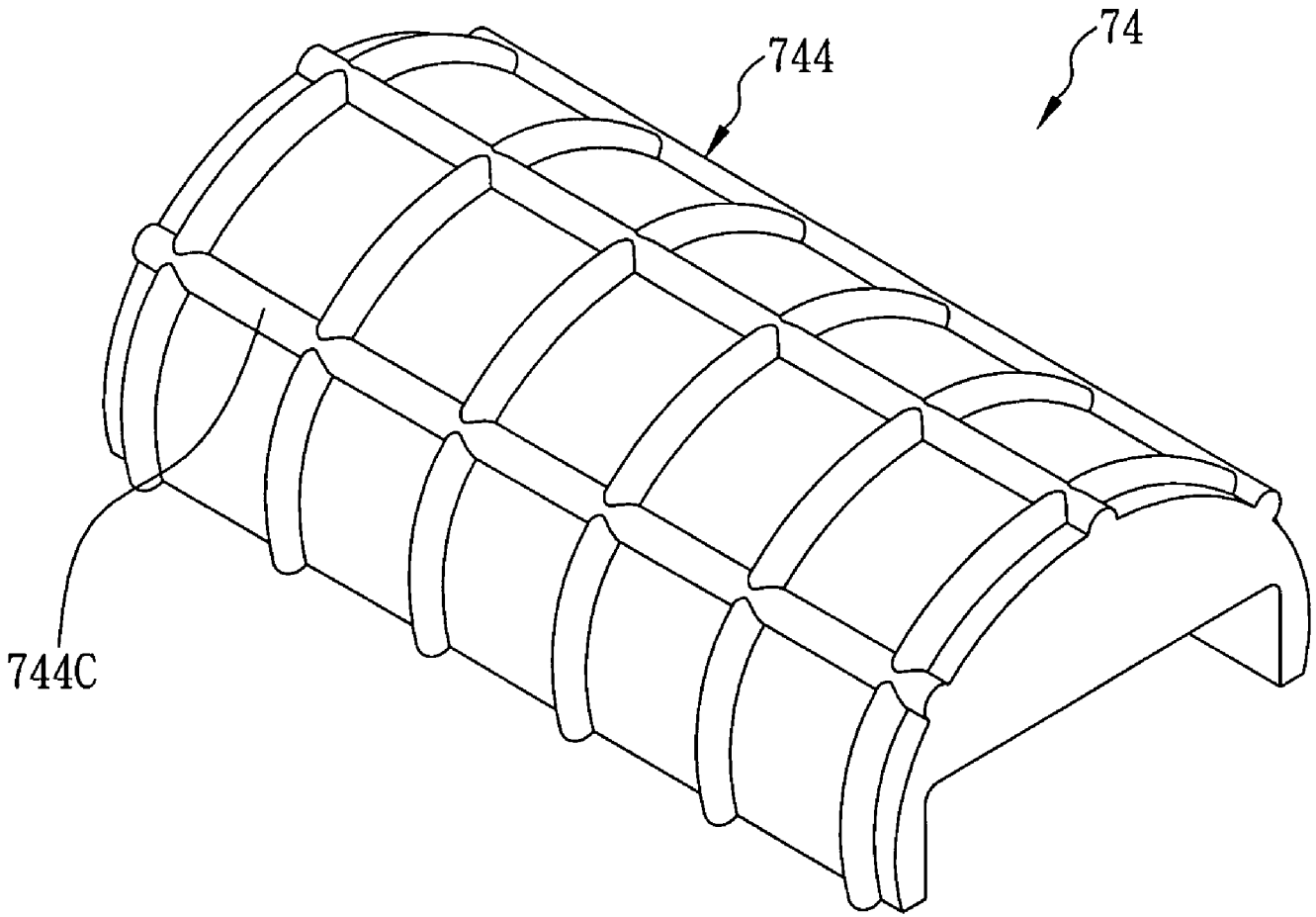
FIG. 7C is a further schematic view of a shelter body of the present invention.

With reference to FIGS. 7A to 7C for another preferred embodiment of the present invention, the shelter body 74 includes a slippery-resisting portion 744 disposed on an opposite side of the main body for facilitating users to apply forces to push or pull the shelter body 74, so as to improve the convenience of operating the computer peripheral device. The design of the slippery-resisting portion 744 may vary as needed. For instance, the shelter body 74 includes a rough area 744A, a decoration object 744B (such as a precious stone) or a protruding thread area 744C, and the shelter body 74 may have a special stylish design (as shown in 7C) to enhance the aesthetic appearance of computer peripheral device. In FIGS. 3 and 6, the casing 30, 50 further includes a suspending portion 35, 55 disposed at a position away from an end of the connecting terminal 322, 522, wherein the suspending portion 35, 55 is a rod having a penetrating hole 351, 551 thereon, such that a ring (as indicated by the dotted line in FIG. 3) or a string (as indicated by the dotted line in FIG. 6) can be used for carrying the computer peripheral device 3, 5 easily, and users can change the stylish form of the shelter body 34, 54 to make the computer peripheral device 3, 5 as a decoration item.

In summation of the description above, the computer peripheral device in accordance with the present invention has the following advantages:

1. The casing 30 and shelter body 34 of the computer peripheral device 3 as shown in FIG. 3 are manufactured by the stamping technology, and thus the manufacturing procedure is simplified greatly for the mass production, and the casing 30 and the shelter body 34 are connected by simply using the shaft 33 and the elastic insert pin 331, and thus the production cost of the computer peripheral device 3 is very low.

2. Since the shelter body 34 is connected with the casing 30 by using the shaft 33, therefore users can change the shelter body 34 easily, and the shelter body 74 of the computer peripheral device 3 may come with different forms as shown in FIGS. 7A~7C to satisfy the user requirement for new stylish designs.

3. The circuits and electronic components of the computer peripheral device 3 are packaged directly into the main body 32 by the Chip On Board (COB) technology, and thus the volume of the main body 32 can be reduced to meet the trend of the compact design.

4. Users simply require using a hand to push or turn the shelter body 34 to expose or cover the connecting terminal 322 of the main body 32 of the computer peripheral device 3. Therefore, the overall operation of the computer peripheral device 3 is user-friendly.

While the invention has been described by means of specific embodiments, numerous modifications and variations could be made thereto by those skilled in the art without departing from the scope and spirit of the invention set forth in the claims.

What is claimed is:

1. A computer peripheral device with a movable protective shelter body, which is connectable to a socket of a microcomputer device, comprising:

a casing being a substantially U-shaped cross-section and having two parallel corresponding first sidewalls, wherein a first containing space is formed between the two first sidewalls, and an end of the casing is configured to be embedded into the socket of the microcomputer device when the computer peripheral device is connected to the socket;

a main body being a flat plate fixed in the first containing space and having a connecting terminal disposed on a lateral surface and at a position proximate to an end of the main body, wherein the back of the connecting terminal is aligned towards the first containing space, such that when the computer peripheral device is connected to the socket, the connecting terminal can be electrically coupled to the socket;

at least one shaft disposed on the casing at a position away from the connecting terminal and having an elastic insert pin disposed separately on both ends of the shaft, wherein an end of each elastic insert pin penetrates through the two first sidewalls at a position away from the main body; and a shelter body having two corresponding second sidewalls disposed on a surface of the shelter body, wherein internal sides of the two second sidewalls are parallel to each other and form a second containing space between the two second sidewalls, internal surfaces of two second corresponding sidewalls have a separate slide slot, and the slide slot includes at least one positioning slot with a sunken depth greater than that of the slide slot, such that when the shelter body is sheathed onto an exterior of the casing, the casing is accommodated into the second containing space, and an end of each elastic insert pin can be embedded into each slide slot and moved along the slide slot;

thereby, when the shelter body and the casing are engaged with each other, and an end of each elastic insert pin is penetrated through two first sidewalls of the casing and embedded into each slide slot of the shelter body, the casing can be moved along the slide slot of the shelter body for exposing or covering the connecting terminal in the main body of the casing.

2. The computer peripheral device of claim 1, wherein the first sidewall of the casing comes with a height from 3 mm to 4 mm.

3. The computer peripheral device of claim 2, wherein the shelter body comes with a back facing towards a surface of the main body and includes a slippery-resisting portion.

4. The computer peripheral device of claim 3, wherein the shelter body includes a suspending portion disposed at a position away from the connecting terminal, and the suspending portion includes a penetrating hole.

5. The computer peripheral device of claim 4, wherein the connecting terminal comes with a Universal Serial Bus (USB) transmission specification.

6. The computer peripheral device of claim 5, wherein the computer peripheral device is a flash disk.

* * * * *